US007856765B1

(12) United States Patent
Su

(10) Patent No.: US 7,856,765 B1
(45) Date of Patent: Dec. 28, 2010

(54) SEISMIC DAMPER

(76) Inventor: Yung-Feng Su, 15F-1, No. 13, Sec. 2, Huan-Nan Rd., Ping-Chen City, Taoyuan Hsien (TW)

( * ) Notice: Subject to any disclaimer, the term of this patent is extended or adjusted under 35 U.S.C. 154(b) by 0 days.

(21) Appl. No.: 12/858,441

(22) Filed: Aug. 18, 2010

Related U.S. Application Data

(62) Division of application No. 11/974,017, filed on Oct. 10, 2007, now Pat. No. 7,797,886.

(30) Foreign Application Priority Data

May 17, 2007 (TW) ..... 96117631 A

(51) Int. Cl.
*E04B 1/98* (2006.01)

(52) U.S. Cl. ..... 52/167.1; 52/167.3; 52/167.4; 248/632; 248/638

(58) Field of Classification Search ..... 248/632, 248/638, 220.22, 220.21; 52/167, 167.1, 52/167.3, 167.4, 573, 646; 403/119, 161, 403/171
See application file for complete search history.

(56) References Cited

U.S. PATENT DOCUMENTS 3,973,078 A * 8/1976 Wolf et al. ..... 174/42
4,823,522 A * 4/1989 White ..... 52/167.7
5,533,307 A * 7/1996 Tsai et al. ..... 52/167.3
5,630,298 A * 5/1997 Tsai et al. ..... 52/167.3
5,971,347 A * 10/1999 Tsai et al. ..... 248/618
7,293,939 B2 * 11/2007 Abbott et al. ..... 405/196
7,797,886 B2 * 9/2010 Su ..... 52/167.1

* cited by examiner

*Primary Examiner*—Terrell McKinnon
*Assistant Examiner*—Todd M Epps
(74) *Attorney, Agent, or Firm*—David N. Lathrop

(57) ABSTRACT

A seismic damper includes upper and lower brackets, and a link mechanism. The upper bracket is formed with an upper hole. The lower bracket is formed with lower and intermediate holes. The link mechanism includes a support link, and first, second, and third pivot joints. The support link has first and second ends, each of which is formed with a through-hole, and an intermediate portion, which is formed with a through-hole. The first pivot joint extends through the upper hole in the upper bracket and the through-hole in the first end of the support link. The second pivot joint extends through the lower hole in the lower bracket and the through-hole in the second end of the support link. The third pivot joint extends through the intermediate hole in the lower bracket and the through-hole in the intermediate portion of the support link.

9 Claims, 7 Drawing Sheets

SEISMIC DAMPER

CROSS-REFERENCE TO RELATED APPLICATION

This application claims priority of Taiwanese application no. 096117631, filed on May 17, 2007.

BACKGROUND OF THE INVENTION

1. Field of the Invention

This invention relates to a seismic damper, more particularly to a seismic damper that is capable of sustaining relatively strong seismic forces.

2. Description of the Related Art

FIG. 1 illustrates a conventional seismic damper for permitting relative movement of supported and supporting structures (not shown) in a first direction, as indicated by arrow (A), due to seismic forces. The conventional seismic damper includes upper and lower brackets 13, 14, and a link mechanism 1. Each of the upper and lower brackets 13, 14 is secured to a respective one of the supported and supporting structures. The link mechanism 1 includes a plurality of plates 12. Each of the plates 12 has a first end connected fixedly to the upper bracket 13, and a second end connected pivotably to the lower bracket 14. In particular, the link mechanism 1 further includes a plurality of couplers 11, each of the which is connected fixedly to the second end of a respective one of the plates 12, and a plurality of pivot joints 15, each of which interconnects the lower bracket 14 and a respective one of couplers 11.

The aforementioned conventional seismic damper is disadvantageous in that, since the first ends of the plates 12 are connected fixedly to the upper bracket through welding, undesirable thermal stress is produced between the first ends of the plates 12 and the upper bracket 13. Furthermore, since the plates 12 are disposed transverse to the first direction (A), the conventional seismic damper has a relatively large width.

SUMMARY OF THE INVENTION

Therefore, the object of the present invention is to provide a seismic damper that can overcome the aforesaid drawbacks of the prior art.

According to an aspect of the present invention, a seismic damper for permitting relative movement of supported and supporting structures in a first direction due to seismic forces comprises upper and lower brackets, and a link mechanism. The upper bracket is adapted to be secured to the supported structure and is formed with an upper hole therethrough. The lower bracket is spaced apart from the upper bracket in a second direction transverse to the first direction, is adapted to be secured to the supporting structure, and is formed with lower and intermediate holes therethrough. The link mechanism includes a support link, first and second pivot joints, and a third pivot joint. The support link has first and second ends, each of which is formed with a through-hole therethrough, and an intermediate portion, which is disposed between the first and second ends thereof and which is formed with a through-hole therethrough. The first pivot joint extends through the upper hole in the upper bracket and the through-hole in the first end of the support link. The second pivot joint extends through the lower hole in the lower bracket and the through-hole in the second end of the support link. The third pivot joint is disposed between the first and second pivot joints, and extends through the intermediate hole in the lower bracket and the through-hole in the intermediate portion of the support link. The upper hole in the upper bracket has a size larger than that of the through-hole in the first end of the support link.

According to another aspect of the present invention, a seismic damper for permitting relative movement of supported and supporting structures in a first direction due to seismic forces comprises upper and lower brackets, an intermediate bracket, and a link mechanism. The upper bracket is adapted to be secured to the supported structure, and includes a horizontal bracket, and a pair of vertical bracket members, each of which is formed with an upper hole therethrough. The lower bracket is spaced apart from the upper bracket in a second direction transverse to the first direction, is adapted to be secured to the supported structure, and includes a pair of vertical bracket members, each of which is formed with a lower hole therethrough. The intermediate bracket is disposed between the upper and lower brackets, is adapted to be secured to the supporting structure, and includes a pair of vertical bracket members, each of which is aligned with a respective one of the vertical bracket members of the upper bracket and a respective one of the vertical bracket members of the lower bracket in the second direction and each of which is formed with an intermediate hole therethrough. The link mechanism includes a support link, first and second pivot joints, and a third pivot joint. The support link is disposed between the vertical bracket members of each of the upper, lower, and intermediate brackets, and has first and second ends, each of which is formed with a through-hole therethrough, and an intermediate portion, which is disposed between the first and second ends thereof and which is formed with a through-hole therethrough. The first pivot joint extends through the upper hole in each of the vertical bracket members of the upper bracket and the through-hole in the first end of the support link. The second pivot joint extends through the lower hole in each of the vertical bracket members of the lower bracket and the through-hole in the second end of the support link. The third pivot joint is disposed between the first and second pivot joints, and extends through the intermediate hole in each of the vertical bracket members of the intermediate bracket and the through-hole in the intermediate portion of the support link. The upper hole in each of the vertical bracket members of the upper bracket has a size larger than that of the through-hole in the first end of the support link.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
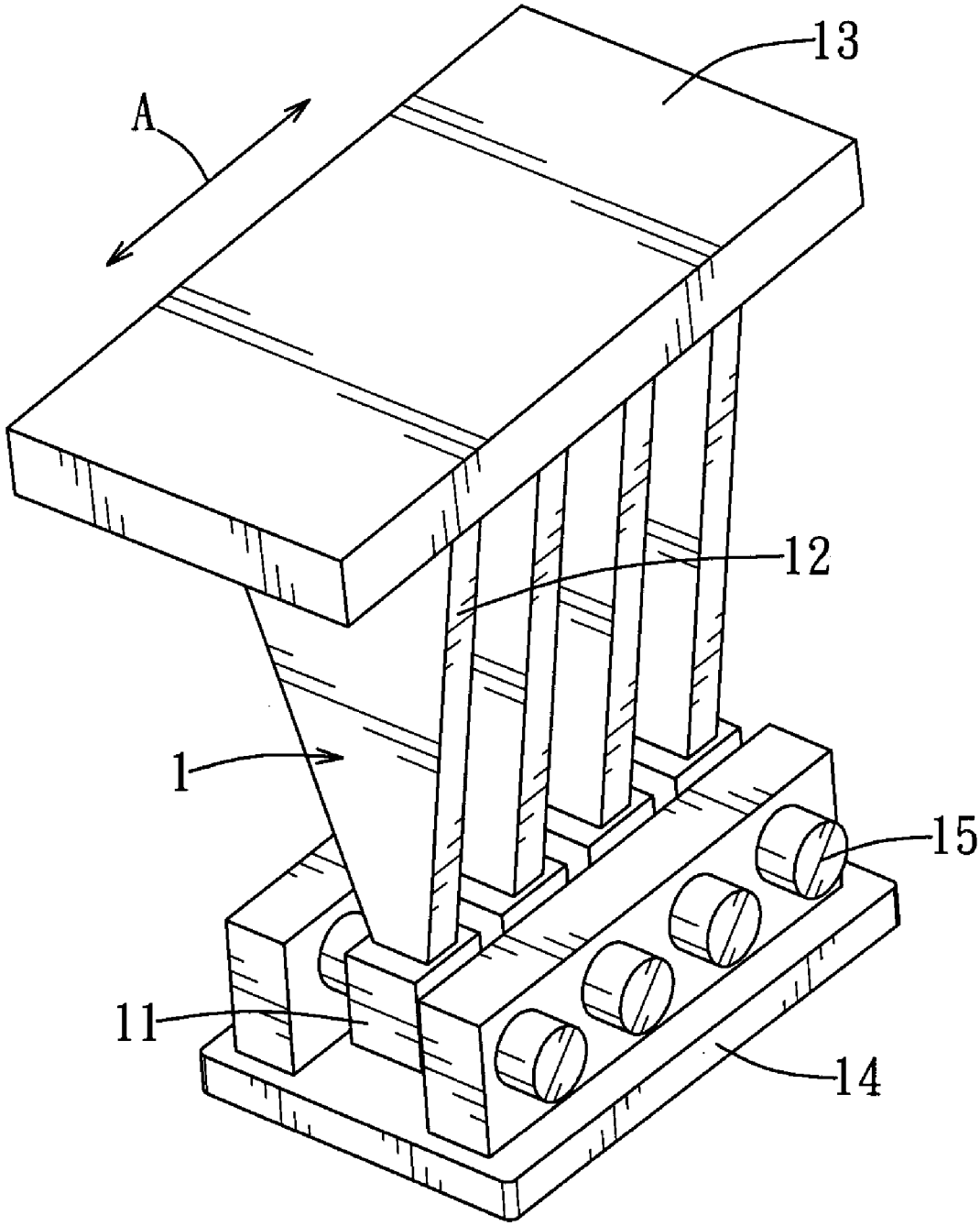
FIG. 1 PRIOR ART
FIG. 1 is a perspective view of a conventional seismic damper.

Before the present invention is described in greater detail, it should be noted that like elements are denoted by the same reference numerals throughout the disclosure.

Figure 2:
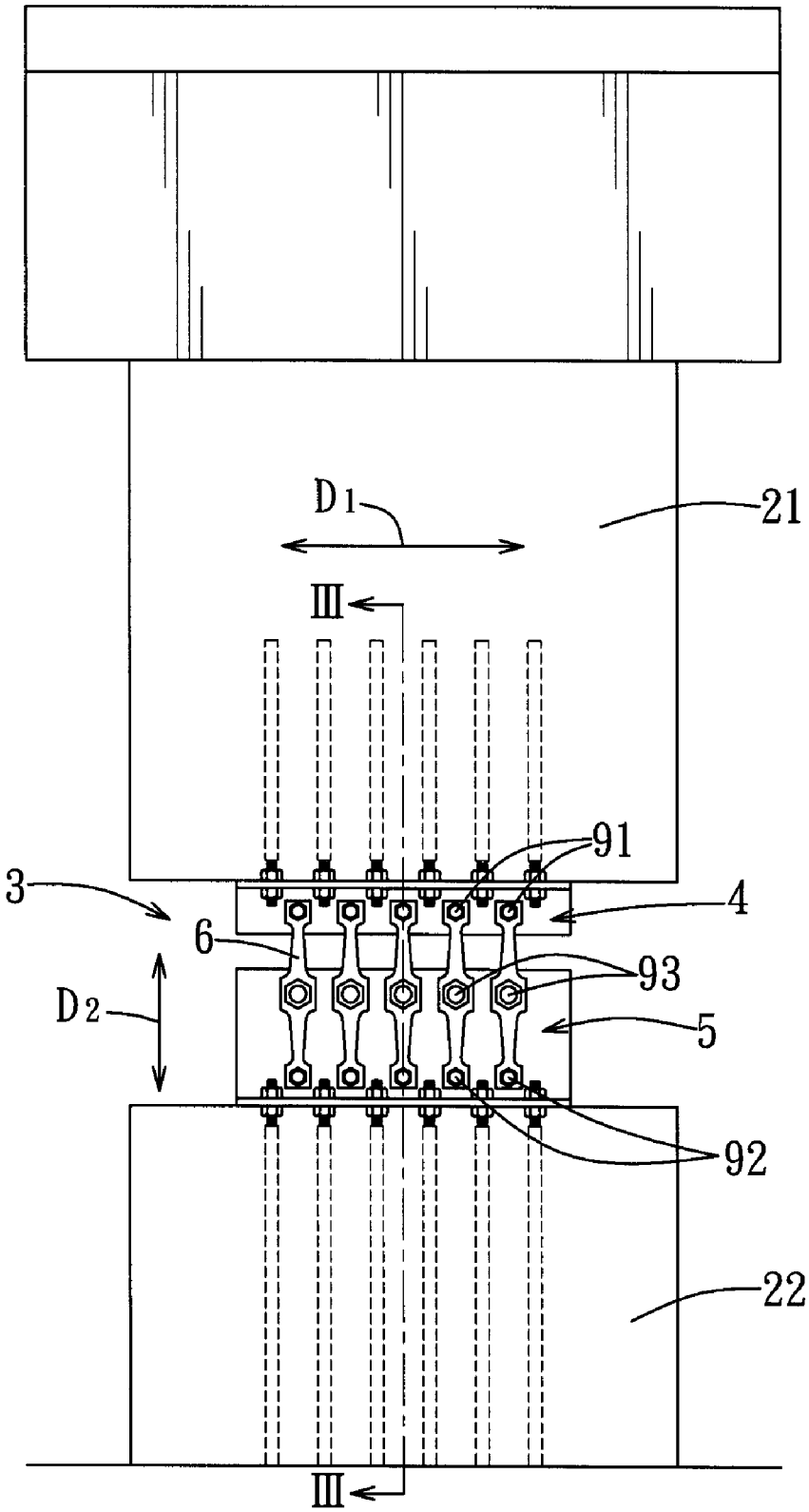
FIG. 2 is a schematic view of the first preferred embodiment of a seismic damper secured between supported and supporting structures according to this invention.

Referring to FIG. 2, the first preferred embodiment of a seismic damper 3 according to this invention is shown to include upper and lower brackets 4, 5, and a link mechanism 6.

The seismic damper 3 of this embodiment permits relative movement between supported and supporting structures 21, 22 in a first direction, as indicated by arrow (D1), due to seismic forces, in a manner that will be described hereinafter.

Each of the supported and supporting structures 21, 22 may be a wall, a beam, a column, or a bridge.

Figure 3:
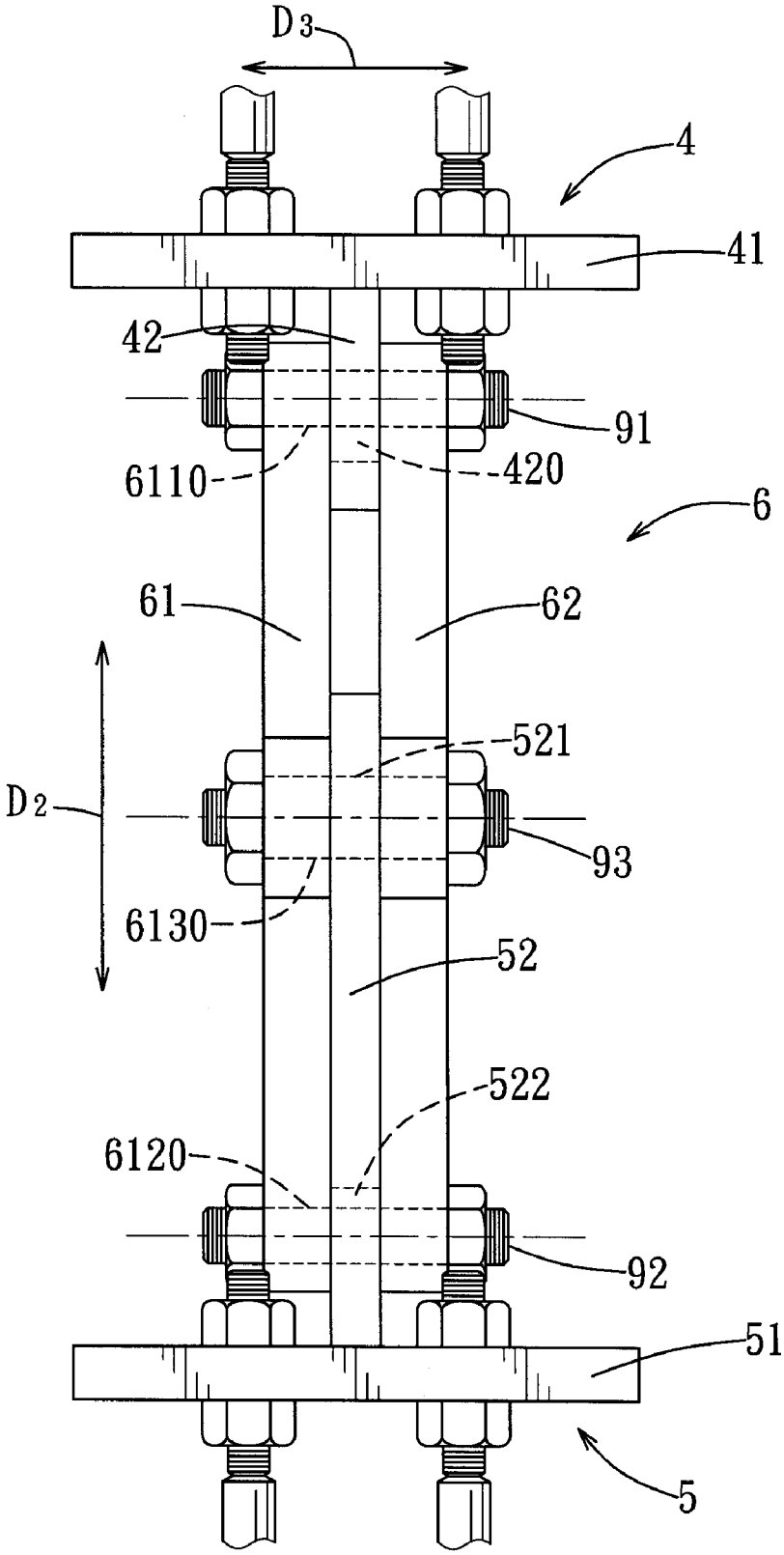
FIG. 3 is a partial sectional view of the first preferred embodiment taken on line III-III of FIG. 2.
Figure 4:
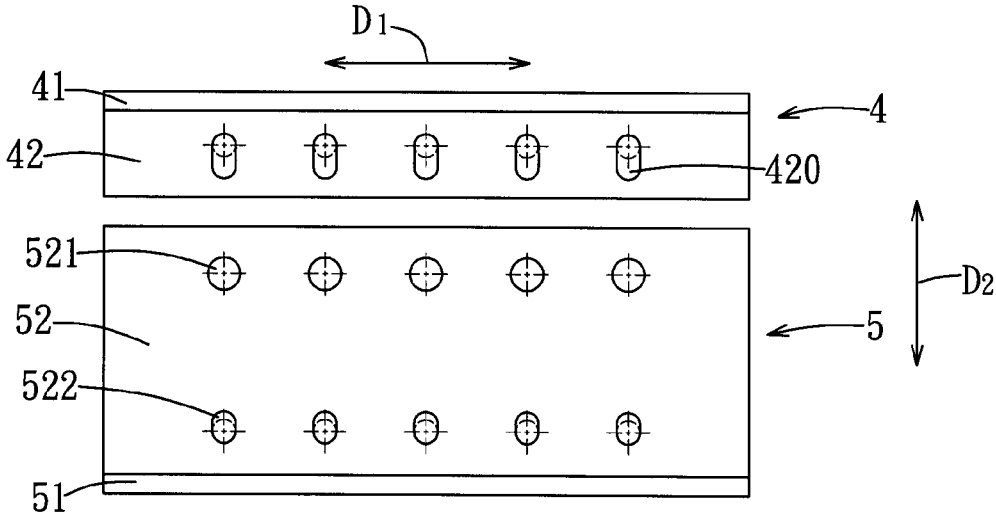
FIG. 4 is a schematic view illustrating upper and lower brackets of the first preferred embodiment.

With further reference to FIG. 3, the upper bracket 4 has a generally T-shaped cross-section across a plane transverse to the first direction (D1), and includes horizontal and vertical bracket members 41, 42. The horizontal bracket member 41 of the upper bracket 4 is secured to the supported structure 21, such as by bolting or welding. The vertical bracket member 42 of the upper bracket 4 extends transversely from the horizontal bracket member 41 of the upper bracket 4 toward the lower bracket 5. In this embodiment, as best shown in FIG. 4, the vertical bracket member 42 of the upper bracket 4 is formed with a plurality of upper holes 420 therethrough that are spaced apart from each other in the first direction (D1).

The lower bracket 5 is spaced apart from the upper bracket 4 in a second direction, as indicated by arrow (D2), transverse to the first direction (D1), has a generally inverted T-shaped cross-section across a plane transverse to the first direction (D1), and includes horizontal and vertical bracket members 51, 52. The horizontal bracket member 51 of the lower bracket 5 is secured to the supporting structure 22, such as by bolting or welding. The vertical bracket member 52 of the lower bracket 5 extends transversely from the horizontal bracket member 51 of the lower bracket 5 toward the upper bracket 4 and is aligned with the vertical bracket member 42 of the upper bracket 4 in the second direction (D2). In this embodiment, as best shown in FIG. 4, the vertical bracket member 52 of the lower bracket 5 is formed with a plurality of lower holes 522 therethrough that are spaced apart from each other in the first direction (D1) and a plurality of intermediate holes 521 therethrough that are spaced apart from each other in the first direction (D1).

The link mechanism 6 includes a plurality of first support links 61, a plurality of second support links 62, a plurality of first pivot joints 91, a plurality of second pivot joints 92, and a plurality of third pivot joints 93.

Since the first support links 61 are identical in structure, only one of the first support links 61 will be described herein.

Figure 5:
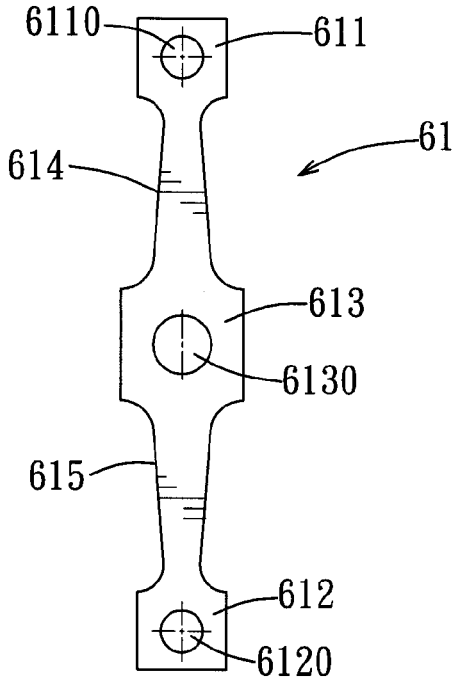
FIG. 5 is a schematic view illustrating a support link of the first preferred embodiment

With further reference to FIG. 5, the first support link 61 has first and second ends 611, 612, and an intermediate portion 613 disposed between the first and second ends 611, 612 thereof. Each of the first and second ends 611, 612, and the intermediate portion 613 of the first support link 61 is formed with a through-hole therethrough 6110, 6120, 6130.

In this embodiment, each of the upper holes 420 in the vertical bracket member 42 of the upper bracket 4 has a size larger than that of the through-hole 6110 in the first end 611 of the first support link 61. Preferably, each of the upper holes 420 in the vertical bracket member 42 of the upper bracket 4 is an elongated hole that extends in the second direction (D2), and the through-hole 6110 in the first end 611 of the first support link 61 is a circular hole. Moreover, each of the lower holes 522 in the vertical bracket member 52 of the lower bracket 5 has a size larger than that of the through-hole 6120 in the second end 612 of the first support link 61. Preferably, each of the lower holes 522 in the vertical bracket member 52 of the lower bracket 5 is an elongated hole that extends in the second direction (D2), and the through-hole 6120 in the second end 612 of the first support link 61 is a circular hole. Further, each of the intermediate holes 521 in the vertical bracket member 52 of the lower bracket 5 has the same size as that of the through-hole 6130 in the intermediate portion 613 of the first support link 61. Preferably, each of the intermediate holes 521 in the vertical bracket member 52 of the lower bracket 5 and the through-hole 6130 in the intermediate portion 613 of the first support link 61 is a circular hole.

The first support link 61 further has a first interconnecting portion 614 that interconnects the first end 611 and the intermediate portion 613 thereof and that tapers toward the first end 611 thereof, and a second interconnecting portion 615 that interconnects the second end 612 and the intermediate portion 613 thereof and that tapers toward the second end 612 thereof. In this embodiment, the first and second interconnecting portions 614, 615 of the first support link 61 have the same length. In an alternative embodiment, the first and second interconnecting portions 614, 615 of the first support link 61 have different lengths.

It is noted herein that intermediate portion 613 of the first support link 61 has a width wider than those of the first and second ends 611, 612 of the first support link 61.

Each of the second support links 62 is spaced apart from and is aligned with a respective one of the first support links 61 in a third direction, as indicated by arrow (D3), transverse to the first and second directions (D1, D2).

The vertical bracket member 42, 52 of each of the upper and lower brackets 4, 5 is disposed between each aligned pair of the first and second support links 61, 62.

Since each of the second support links 62 is identical in structure to the first support links 61, a detailed description thereof is omitted herein for the sake of brevity.

Each of the first pivot joints 91 extends through a respective one of the upper holes 420 in the vertical bracket member 42 of the upper bracket 4, the through-hole 6110 in the first end 611 of a respective one of the first support links 61, and the through-hole in the first end of a respective one of the second support links 62, and is movable along the respective one of the upper holes 420 in the vertical bracket member 42 of the lower bracket 4.

Each of the second pivot joints 92 extends through a respective one of the lower holes 522 in the vertical bracket member 52 of the lower bracket 5, the through-hole 6120 in the second end 612 of a respective one of the first support links 61, and the through-hole in the second end of a respective one of the second support links 62, and is movable along the respective one of the lower holes 522 in the vertical bracket member 52 of the lower bracket 5.

Each of the third pivot joints 93 is disposed between the first and second pivot joints 91, 92, and extends through a respective one of the intermediate holes 521 in the vertical bracket member 52 of the lower bracket 5, the through-hole 6130 in the intermediate portion 613 of a respective one of the first support links 61, and the through-hole in the intermediate portion of a respective one of the second support links 62.

In this embodiment, each of the first pivot joints 91 is aligned with a respective one of the second pivot joints 92 and a respective one of the pivot joints 93 in the second direction. Preferably, each of the first, second, and third pivot joints 91, 92, 93 is constituted by a nut and a bolt.

Figure 6:
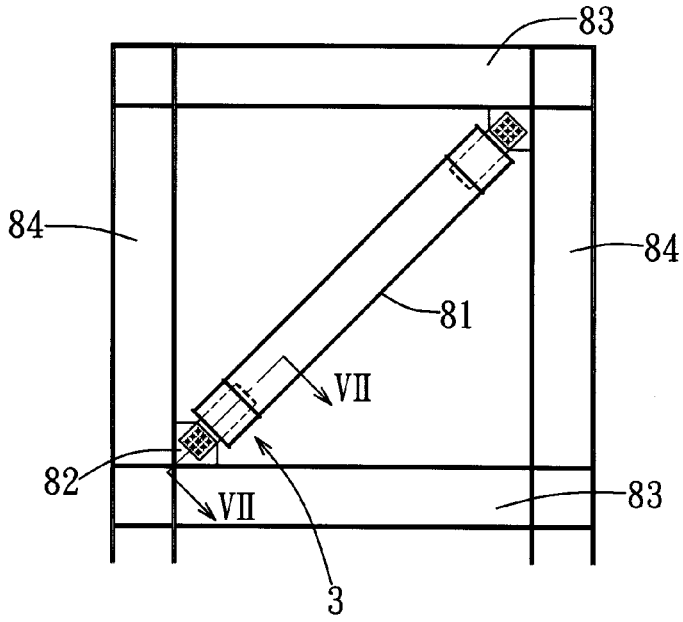
FIG. 6 is a schematic view of the second preferred embodiment of a seismic damper secured between supported and supporting structures according to this invention.

FIG. 6 illustrates the second preferred embodiment of a seismic damper 3 according to this invention. When compared to the previous embodiment, the supported structure 81 is a diagonal brace structure, and the supporting structure is a junction of a beam 83 and a column 84.

Figure 7:
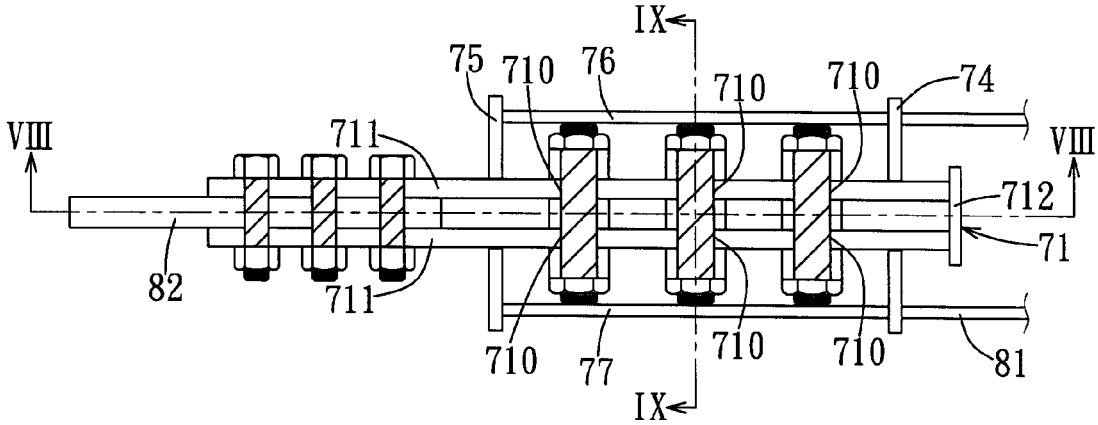
FIG. 7 is a partial sectional view of the second preferred embodiment taken on line VII-VII of FIG. 6.
Figure 8:
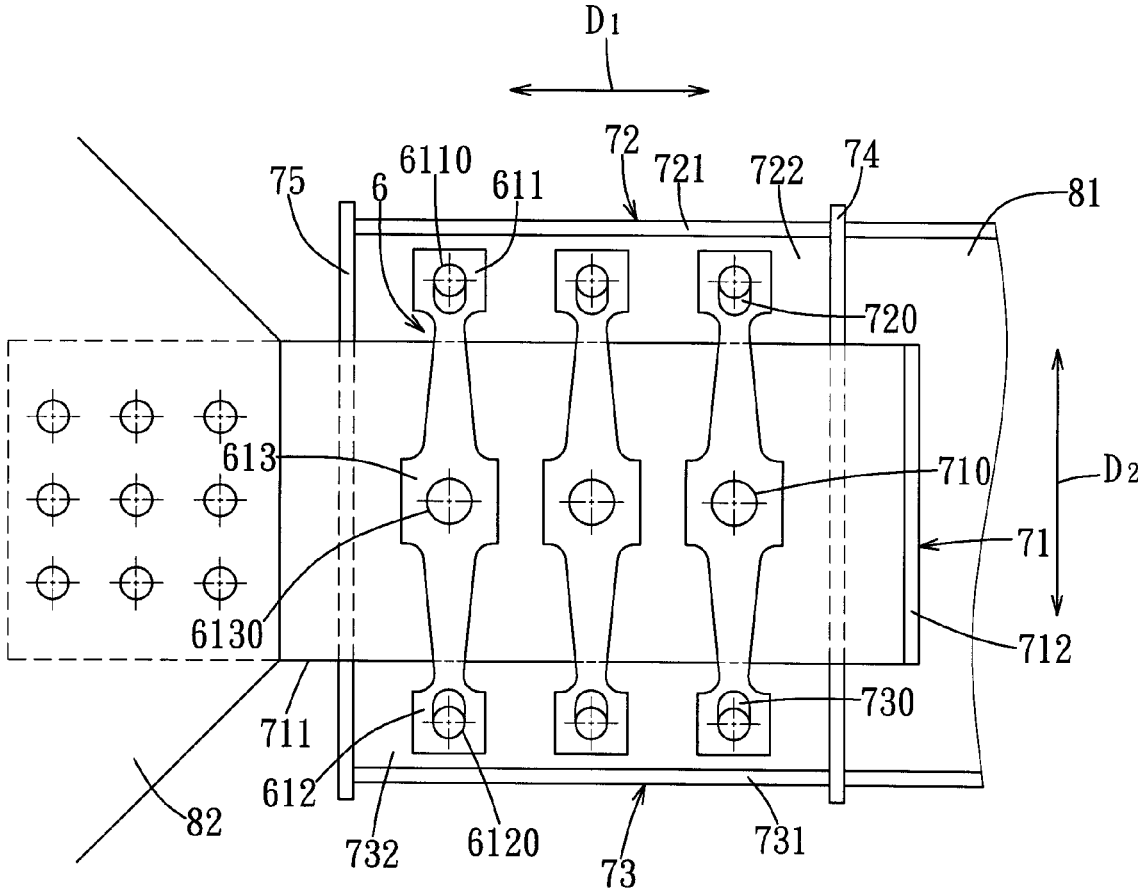
FIG. 8 is a partial sectional view of the second preferred embodiment taken on line VIII-VIII of FIG. 7.
Figure 9:
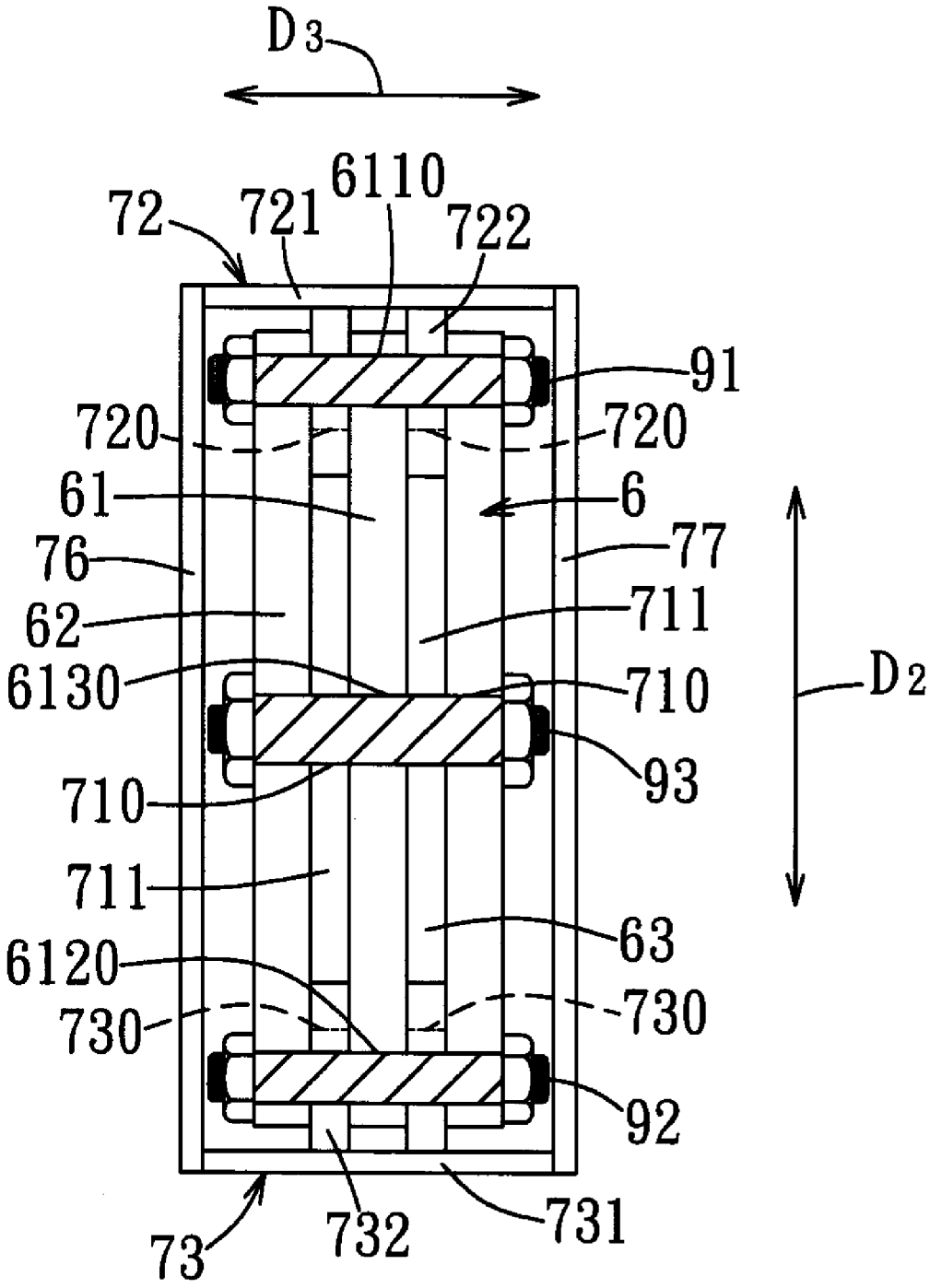
FIG. 9 is a partial sectional view of the second preferred embodiment taken on line IX-IX of FIG. 7.

With further reference to FIGS. 7 to 9, the upper bracket 72 includes a horizontal bracket member 721, and a pair of vertical bracket members 722, each of which extends transversely from the horizontal bracket member 721 thereof toward the lower bracket 73 and is formed with a plurality of upper holes 720 therethrough. In this embodiment, as best shown in FIG. 8, the upper holes 720 in each of the vertical bracket members 722 of the upper bracket 72 are spaced apart from each other in the first direction (D1).

The lower bracket 73 is spaced apart from the upper bracket 72 in the second direction (D2), and includes a horizontal bracket member 731, and a pair of vertical bracket members 732, each of which extends transversely from the horizontal bracket member 731 thereof toward the upper bracket 72 and is formed with a plurality of lower holes 730 therethrough. In this embodiment, as best shown in FIG. 8, the lower holes 730 in each of the vertical bracket members 732 of the lower bracket 73 are spaced apart from each other in the first direction (D1).

The seismic damper 3 of this embodiment further includes an intermediate bracket 71 that is disposed between the upper and lower brackets 72, 73 and that is secured to the supporting structure through amounting seat 82. In this embodiment, the intermediate bracket 71 includes a pair of vertical bracket members 711, each of which is aligned with a respective one of the vertical bracket members 722 of the upper bracket 72 and a respective one of the vertical bracket members 732 of the lower bracket 73 in the second direction (D2) and each of which is formed with a plurality of intermediate holes 710 therethrough. Furthermore, as best shown in FIG. 8, the intermediate holes 710 in each of the vertical bracket members 711 of the intermediate bracket 71 are spaced apart from each other in the first direction (D1).

The intermediate bracket 71 further includes a coupler 712 that interconnects the vertical bracket members 711 thereof.

It is noted herein that each of the vertical bracket members 711 of the intermediate bracket 71 is in sliding contact with a respective one of the vertical bracket members 722 of the upper bracket 72 and a respective one of the vertical bracket members 732 of the lower bracket 73. Alternatively, each of the vertical bracket members 711 of the intermediate bracket 71 may be spaced apart from the respective one of the vertical bracket members 722 of the upper bracket 72 and the respective one of the vertical bracket members 732 of the lower bracket 73.

The link mechanism 6 further includes a plurality of third support links 63, each of which is spaced apart from and is aligned with a respective one of the first support links 61 and a respective one of the second support links 62 in the third direction (D3).

Since each of the third support links 63 is identical in structure to the first support links 61, a detailed description thereof is omitted herein for the sake of brevity.

Each of the first support links 61 is disposed between the vertical bracket members 722, 732, 711 of each of the upper, lower, and intermediate brackets 72, 73, 71.

The vertical bracket members 722, 732, 711 of each of the upper, lower, and intermediate brackets 72, 73, 71 are disposed between each aligned pair of the second and third support links 62, 63.

In this embodiment, each of the upper holes 720 in each of the vertical bracket members 722 of the upper bracket 72 has a size larger than that of the through-hole 6110 in the first end 611 of the first support link 61. Preferably, each of the upper holes 720 in each of the vertical bracket members 722 of the upper bracket 72 is an elongated hole that extends in the second direction (D2). Moreover, each of the lower holes 730 in each of the vertical bracket members 732 of the lower bracket 73 has a size larger than that of the through-hole 6120 in the second end 612 of the first support link 61. Preferably, each of the lower holes 730 in each of the vertical bracket members 732 of the lower bracket 73 is an elongated hole that extends in the second direction (D2). Further, each of the intermediate holes 710 in each of the vertical bracket members 711 of the intermediate bracket 71 has the same size as that of the through-hole 6130 in the intermediate portion 613 of the first support link 61. Preferably, each of the intermediate holes 710 in the vertical bracket members 711 of the intermediate bracket 71 and the through-hole 6130 in the intermediate portion 613 of the first support link 61 is a circular hole.

Each of the first pivot joints 91 extends through a respective one of the upper holes 720 in each of the vertical bracket members 722 of the upper bracket 72, the through-hole 6110 in the first end 611 of a respective one of the first support links 61, the through-hole in the first end of a respective one of the second support links 62, and the through-hole in the first end of a respective one of the third support links 63, and is movable along the respective one of the upper holes 720 in each of the vertical bracket members 722 of the upper bracket 72.

Each of the second pivot joints 92 extends through a respective one of the lower holes 730 in each of the vertical bracket members 732 of the lower bracket 73, the through-hole 6120 in the second end 612 of a respective one of the first support links 61, the through-hole in the second end of a respective one of the second support links 62, and the through-hole in the second end of a respective one of the third support links 63, and is movable along the respective one of the lower holes 730 in each of the vertical bracket members 732 of the lower bracket 73.

Each of the third pivot joints 93 extends through a respective one of the intermediate holes 710 in each of the vertical bracket members 711 of the intermediate bracket 71, the through-hole 6130 in the intermediate portion 613 of a respective one of the first support links 61, the through-hole in the intermediate portion of a respective one of the second support links 62, and the through-hole in the intermediate portion of a respective one of the third support links 63.

The seismic damper 3 of this embodiment further includes a cover for concealing the link mechanism 6. The cover includes opposite first and second cover members 74, 75, and opposite third and fourth cover members 76, 77. The first cover member 74 is sleeved slidably on the vertical bracket members 711 of the intermediate bracket 71, is connected to the upper and lower brackets 72, 73, and is secured to the supported structure 81. The second cover member 75 is sleeved slidably on the vertical bracket members 711 of the intermediate bracket 71 and is connected to the upper and lower brackets 72, 73. Each of the third and fourth cover members 76, 77 is connected to the first and second cover members 74, 75 and the upper and lower brackets 72, 73.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A seismic damper for permitting relative movement of supported and supporting structures in a first direction due to seismic forces, said seismic damper comprising:

an upper bracket adapted to be secured to the supported structure, and including a horizontal bracket, and a pair of vertical bracket members, each of which is formed with an upper hole therethrough;

a lower bracket spaced apart from said upper bracket in a second direction transverse to the first direction, adapted to be secured to the supported structure, and including a pair of vertical bracket members, each of which is formed with a lower hole therethrough;

an intermediate bracket disposed between said upper and lower brackets, adapted to be secured to the supporting structure, and including a pair of vertical bracket members, each of which is aligned with a respective one of said vertical bracket members of said upper bracket and a respective one of said vertical bracket members of said lower bracket in the second direction and each of which is formed with an intermediate hole therethrough; and a link mechanism including a first support link that is disposed between said vertical bracket members of each of said upper, lower, and intermediate brackets, and that has first and second ends, each of which is formed with a through-hole therethrough, and an intermediate portion, which is disposed between said first and second ends thereof and which is formed with a through-hole therethrough, a first pivot joint that extends through said upper hole in each of said vertical bracket members of said upper bracket and said through-hole in said first end of said first support link, a second pivot joint that extends through said lower hole in each of said vertical bracket members of said lower bracket and said through-hole in said second end of said first support link, and a third pivot joint that is disposed between said first and second pivot joints, and that extends through said intermediate hole in each of said vertical bracket members of said intermediate bracket and said through-hole in said intermediate portion of said first support link, wherein said upper hole in each of said vertical bracket members of said upper bracket has a size larger than that of said through-hole in said first end of said first support link.

2. The seismic damper as claimed in claim 1, wherein said upper hole in each of said vertical bracket members of said upper bracket is an elongated hole, and said through-hole in said first end of said first support link is a circular hole.

3. The seismic damper as claimed in claim 1, wherein said lower hole in each of said vertical bracket members of said lower bracket has a size larger than that of said through-hole in said second end of said first support link.

4. The seismic damper as claimed in claim 3, wherein said lower hole in each of said vertical bracket members of said lower bracket is an elongated hole, and said through-hole in said second end of said first support link is a circular hole.

5. The seismic damper as claimed in claim 1, wherein said link mechanism further includes second and third support links, each of which is spaced apart from said first support link in a third direction transverse to the first and second directions, said vertical bracket members of each of said upper, lower, and intermediate brackets being disposed between said second and third support links, each of said second and third support links having first and second ends, each of which is formed with a through-hole therethrough, and an intermediate portion, which is disposed between said first and second ends thereof and which is formed with a through-hole therethrough, said first pivot joint further extending through said through-holes in said first ends of said second and third support links, said second pivot joint further extending through said through-holes in said second ends of said second and third support links, said third pivot joint further extending through said through-holes in said intermediate portions of said second and third support links.

6. The seismic damper as claimed in claim 1, further comprising a cover for concealing said link mechanism, said cover including opposite first and second cover members that are sleeved slidably on said vertical bracket members of said intermediate bracket and that are connected to said upper and lower brackets.

7. The seismic damper as claimed in claim 6, wherein said cover further includes opposite third and fourth cover members that are connected to said first and second cover members and said upper and lower brackets.

8. The seismic damper as claimed in claim 1, wherein said intermediate bracket further includes a coupler that interconnects said vertical bracket members thereof.

9. The seismic damper as claimed in claim 1, wherein said first, second, and third pivot joints are aligned in the second direction.

* * * * *